US007694981B2

(12) United States Patent
Heath et al.

(10) Patent No.: US 7,694,981 B2
(45) Date of Patent: Apr. 13, 2010

(54) MULTIPLE USE, TRANSFORMABLE CART

(75) Inventors: Jonathan C. Heath, Mesa, AZ (US); Richard R. Fengler, Mesa, AZ (US); Stephen A. Doyle, Mesa, AZ (US); Dwight L. Engwall, Mesa, AZ (US); Peter K. Bilitsis, Phoenix, AZ (US); Frederick C. Edman, Mesa, AZ (US); Gary E. Jones, Mesa, AZ (US); Thomas G. Klingler, Chandler, AZ (US); Richard D. Tuzzolino, Mesa, AZ (US); Erwin R. Kuhn, Titusville, FL (US); Basilio Penuelas, Mesa, AZ (US); Lawrence M. Apodaca, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 612 days.

(21) Appl. No.: 11/688,442

(22) Filed: Mar. 20, 2007

(65) Prior Publication Data

US 2008/0231149 A1 Sep. 25, 2008

(51) Int. Cl.
*B62B 3/00* (2006.01)

(52) U.S. Cl. ..... 280/79.11; 280/47.26; 280/47.34; 280/651; 280/79.2; 280/79.3

(58) Field of Classification Search ..... 280/828, 280/1.188, 1.204, 1.208, 1.22, 1.23, 43, 43.13, 280/43.17, 651, 47.34, 47.35, 47.41, 79.11, 280/79.2, 79.7, 47.26
See application file for complete search history.

(56) References Cited

U.S. PATENT DOCUMENTS 3,215,483 A * 11/1965 Nelson ..... 312/249.13
3,294,412 A * 12/1966 Good ..... 280/43.13
3,997,213 A * 12/1976 Smith et al. ..... 297/118
5,058,911 A * 10/1991 Hunter et al. ..... 280/47.35
5,129,611 A * 7/1992 Grover et al. ..... 248/688
5,161,811 A * 11/1992 Cheng ..... 280/30
5,290,058 A * 3/1994 Adams et al. ..... 280/651
5,464,236 A * 11/1995 Benting et al. ..... 280/30
5,465,988 A 11/1995 Dennis
5,480,170 A * 1/1996 Kaiser, II ..... 280/30
5,547,205 A * 8/1996 do Rosario Sousa de Cabedo ..... 280/30
5,558,112 A * 9/1996 Strieter ..... 134/103.2
5,611,553 A * 3/1997 Schoeman et al. ..... 280/47.35
5,626,353 A * 5/1997 Campbell ..... 280/47.35
5,738,480 A * 4/1998 Butzen ..... 414/490
5,765,842 A * 6/1998 Phaneuf et al. ..... 280/47.35
5,797,612 A * 8/1998 Buccioni ..... 280/47.26
5,887,878 A * 3/1999 Tisbo et al. ..... 280/47.19
5,893,572 A * 4/1999 Parks ..... 280/47.18
5,971,512 A * 10/1999 Swan ..... 312/281
6,053,587 A * 4/2000 Boerder ..... 312/249.12
6,086,073 A * 7/2000 Tisbo et al. ..... 280/47.26
6,129,366 A * 10/2000 Dettmann et al. ..... 280/47.35

(Continued)

*Primary Examiner*—Glenn Dayoan
*Assistant Examiner*—Jacob Meyer
(74) *Attorney, Agent, or Firm*—Armstrong Teasdale LLP

(57) ABSTRACT

A mobile storage and work cart is described that includes a reconfigurable frame, a plurality of casters extending from the reconfigurable frame and operable for moving the cart, and a work surface attached to the reconfigurable frame and forming a top of the cart. The reconfigurable frame is operable to adjust a height of the work surface.

18 Claims, 5 Drawing Sheets

U.S. PATENT DOCUMENTS 6,213,483 B1 4/2001 Gaffney
6,270,094 B1 8/2001 Campbell
6,279,928 B1 * 8/2001 Biggs, Sr. ..... 280/47.19
6,383,242 B1 * 5/2002 Rogers et al. ..... 55/385.2
6,513,817 B2 * 2/2003 McCue et al. ..... 280/79.2
6,634,668 B2 * 10/2003 Urffer et al. ..... 280/651
6,641,148 B2 * 11/2003 Schmidt ..... 280/47.34
6,648,349 B1 * 11/2003 Waller et al. ..... 280/47.35
6,669,214 B1 12/2003 Domis
6,672,601 B1 * 1/2004 Hofheins et al. ..... 280/47.34
6,758,482 B2 * 7/2004 Stallbaumer ..... 280/47.27
6,767,019 B2 * 7/2004 van Hekken ..... 280/47.35
6,783,563 B1 * 8/2004 Eckhoff et al. ..... 55/356
6,820,878 B2 * 11/2004 Safari et al. ..... 280/47.26
6,824,152 B1 * 11/2004 Scott ..... 280/79.7
6,869,097 B2 3/2005 Prather et al.
6,955,384 B1 * 10/2005 Good ..... 296/3
6,986,431 B2 1/2006 Koester et al.
7,017,603 B1 3/2006 Rosine et al.
7,044,569 B1 * 5/2006 Relyea et al. ..... 312/249.11
7,077,068 B1 * 7/2006 Agee ..... 108/147
7,111,852 B2 * 9/2006 Woods et al. ..... 280/47.34
7,114,733 B2 * 10/2006 Downs ..... 280/47.35
7,144,020 B2 * 12/2006 Huguet ..... 280/47.34
7,398,978 B2 * 7/2008 Cheung ..... 280/42
2001/0030403 A1 * 10/2001 Johnson et al. ..... 280/47.26
2001/0045718 A1 * 11/2001 Boirum ..... 280/47.26
2001/0052681 A1 * 12/2001 Deavila ..... 280/47.19
2002/0096845 A1 * 7/2002 Spann ..... 280/79.2
2004/0000774 A1 * 1/2004 Zeuner ..... 280/651
2004/0212162 A1 * 10/2004 Calmeise et al. ..... 280/47.35
2005/0103823 A1 * 5/2005 Domschot ..... 228/101
2005/0275179 A1 * 12/2005 Whittington ..... 280/79.11
2005/0280228 A1 * 12/2005 Fernandes et al. ..... 280/47.35
2006/0232033 A1 * 10/2006 Pint ..... 280/79.2
2007/0018433 A1 * 1/2007 Sinnamon et al. ..... 280/651
2007/0096416 A1 * 5/2007 Webster ..... 280/79.3
2007/0169843 A1 * 7/2007 Henderleiter ..... 141/315
2009/0152833 A1 * 6/2009 Johnson ..... 280/504

* cited by examiner

MULTIPLE USE, TRANSFORMABLE CART

BACKGROUND OF THE INVENTION

This invention relates generally to the supporting of fabrication and assembly activities, and more specifically, to a multiple use, transformable cart to contain materials, supplies, and work surfaces for supporting fabrication and assembly activities for mockups and new innovations.

Current work tables and carts are not suited for the support of fabrication and assembly activities for mockups and the like. These devices are not capable of fitting through standard door openings or do not have enough storage and work surface space to accommodate the above described activities. Additionally, at least some of the features of current work tables and carts have not taken ergonomic features into account, nor do they provoke "out of the box" thinking. A further problem with current cart configurations is that they tend to blend into the workplace or laboratory surroundings. This makes the device difficult to distinguish, and therefore it is not easily recognizable as a tool for the above described activities.

To summarize, current work tables and carts do not have the ability to securely store materials, provide a work surface of sufficient size for multiple users, and adjust working height for improved ergonomics. Therefore, a user or a team preparing a mockup or performing other innovative activities typically has to round up the needed materials, then sit at a table and performing the desired activities.

BRIEF DESCRIPTION OF THE INVENTION

In one aspect, a mobile storage and work cart is provided that includes a reconfigurable frame, a plurality of casters, and a work surface. The plurality of casters extend from the reconfigurable frame and are operable for moving the cart. The work surface is attached to the reconfigurable frame and forms a top of the cart. The reconfigurable frame is operable to adjust a height of the work surface.

In another aspect, a mobile workstation is provided that comprises a body forming a substantial perimeter of the workstation, a height adjustable work surface configured as a top of the body, a plurality of structural members to which the body is attached, a plurality of casters, and a plurality of shelves and storage units. Each caster is attached to one or more of the structural members which are arranged to provide height adjustment of the work surface. The plurality of shelves and storage units are each slidably engaged with one or more of and configured for containment within the body when not in use.

DETAILED DESCRIPTION OF THE INVENTION

Figure 1:
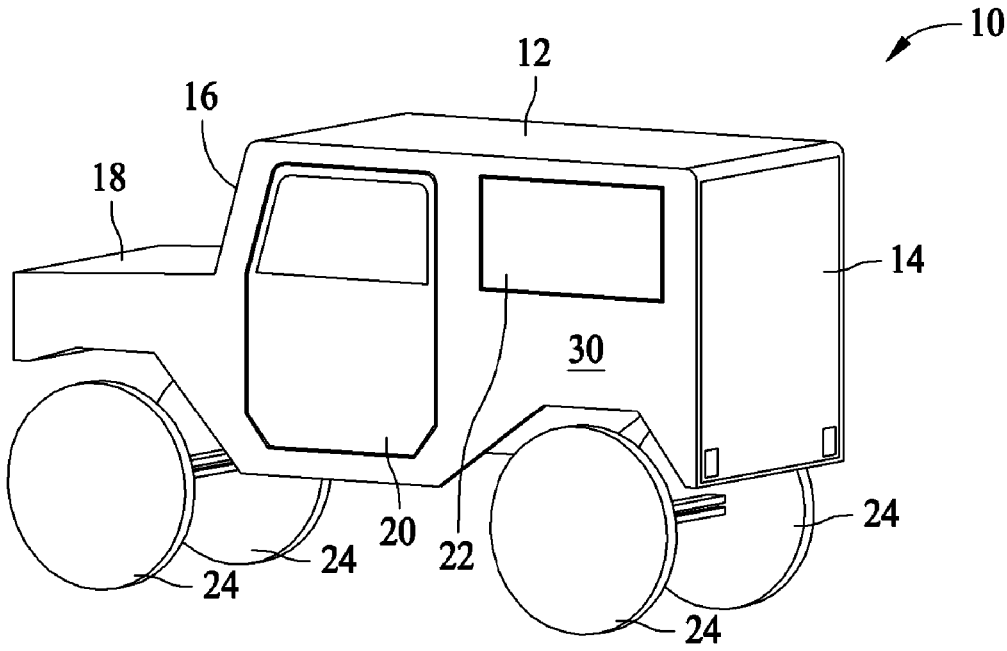
FIG. 1 is an illustration of a multiple use, transformable, storage and work cart.

FIG. 1 is one embodiment of a vehicle shaped, height adjustable, reconfigurable storage cart 10. In the illustrated embodiment, cart 10 configured to operate as an expandable mobile workstation and lockable storage system. In certain embodiments, cart 10 includes height adjustability. Cart 10 includes a frame, casters, height adjustment, rotating platforms, storage bins, durable top work surface and side panels. More specifically, and referring to FIG. 1, cart 10 includes a primary work surface 12, a rear cover or hatch 14, a front 16 and a hood 18. At a first end of cart 10, rear cover 14 is attached to primary work surface 12, for example, using a hinged connection, and as such cover 14 is operable as a secondary work surface which, when deployed, is substantially coplanar with primary work surface 12. At a second end of cart, front 16 and hood 18 are attached to one another, also with a hinged connection, and front 16 is also attached to primary work surface 12 with a hinged connection. When deployed, front 16 is also substantially planar to primary work surface 12, and further supported by hood, which is substantially perpendicular to front 16 and primary work surface 12 when deployed. Front 16 may also be referred to as a windshield, based on a configuration of cart 10.

Cart 10 further includes a plurality of doors 20 (one shown) and windows 22 (one shown) whose functionality is described below. Cart 10 also includes a plurality of wheel mockups 24, which in various embodiments, are purely decorative (cart 10 includes casters (not shown)) as wheel mockups 24 do not touch the ground. In other embodiments, wheels 24 might be configurable as round, secondary work surfaces or as materials that might be utilized in the construction of a scale model or other type of mockup.

As further described below, cart 10 is fabricated using a reconfigurable framework to which is attached a body 30 of cart 10. Portions of this reconfigurable framework are visible in FIGS. 1-5. Attached to this framework are a plurality of casters (not shown in FIG. 1), to provide the mobility for cart 10. Portion of the framework are adjustable, particularly those associated with the casters, as operation of such framework allows for the height adjustment of cart 10, and therefore work surface 12.

Figure 2:
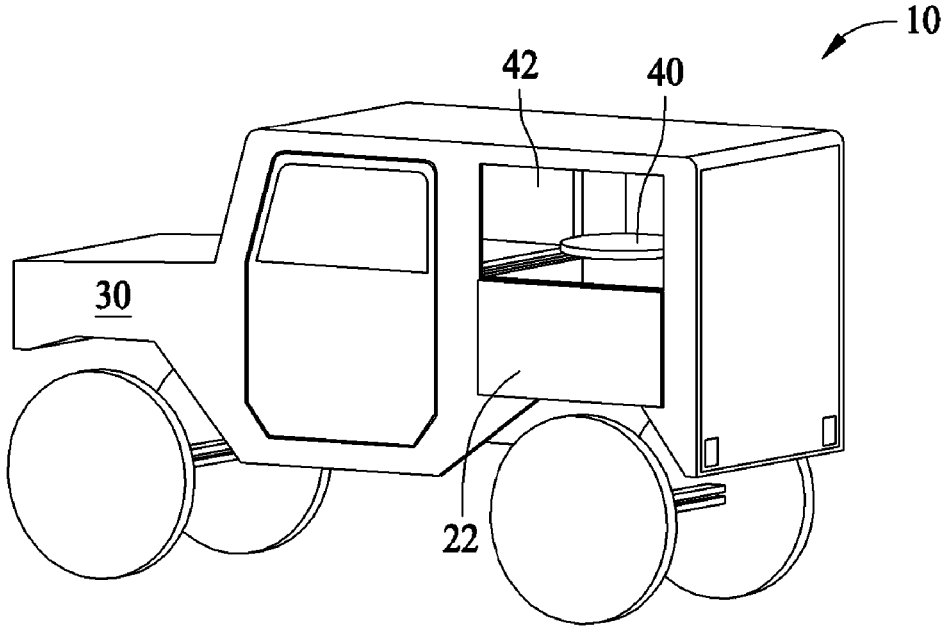
FIG. 2 is an illustration of the cart of FIG. 1 with one "window" open.

FIG. 2 is an illustration of cart 10 with at least one of windows 22 in an open position. In use, cart 10 is rolled into the needed location, and windows 22 are folded down allowing access to one or more rotating devices 40, through an opening 42. These rotating devices 40 are sometimes colloquially referred to as lazy susans, which can be moved through opening 42 from which window 22 is removed, providing access, for example, to more frequently used tools and materials stored thereon. In one embodiment, each rotating device 40 is supported and attached to cart 10 using a hinged arm (not shown) which is further configured to allow rotation of devices 40.

Figure 3:
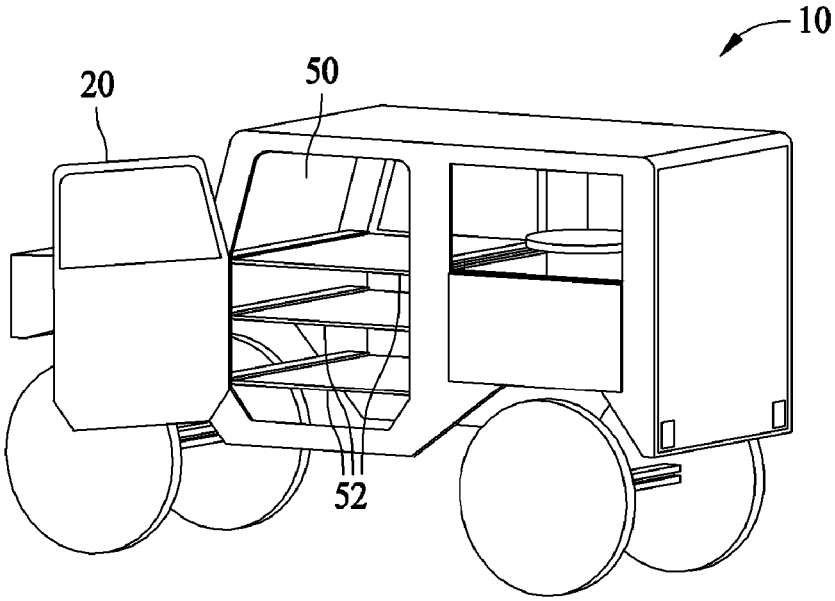
FIG. 3 is an illustration of the cart of FIG. 1 with one door open.

FIG. 3 is an illustration of cart 10 with at least one of doors 20 in an open position, thereby exposing openings 50. When cart 10 is rolled into a work location, and doors 20 may be opened, and access is provided to one or more sliding shelves 52. In one embodiment, shelves 52 can be accessed from either side of cart 10, through respective doors 20. In an embodiment, shelves 52 are also removable through either of doors 20, and a height of each shelf 52 is independently adjustable. Though shown with three shelves 52, cart 10 is configurable to contain other numbers of shelves 52, depending on the configurations of items stored thereon.

Figure 4:
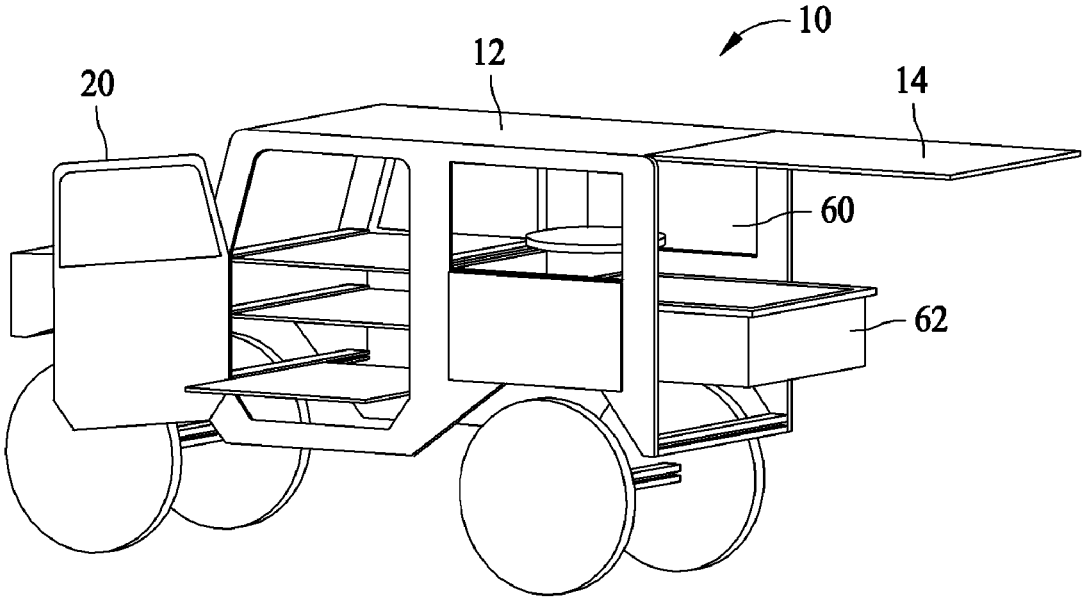
FIG. 4 is an illustration of the cart of FIG. 1 with the rear hatch open, extending a top work surface.

FIG. 4 is an illustration of cart 10 with rear hatch 14 in an open position, thereby exposing opening 60 and one or more storage bins 62 stored within cart 10 and accessible through opening 60. In certain embodiments, storage bins 62 are configured as drawers, and depending on a depth of each storage bin 62, opening 60 may include a number of storage bins 62. As illustrated, and as described above, when rear hatch 14 is locked in an open position, it provides an extension to a primary work surface 12 as described above.

Figure 5:
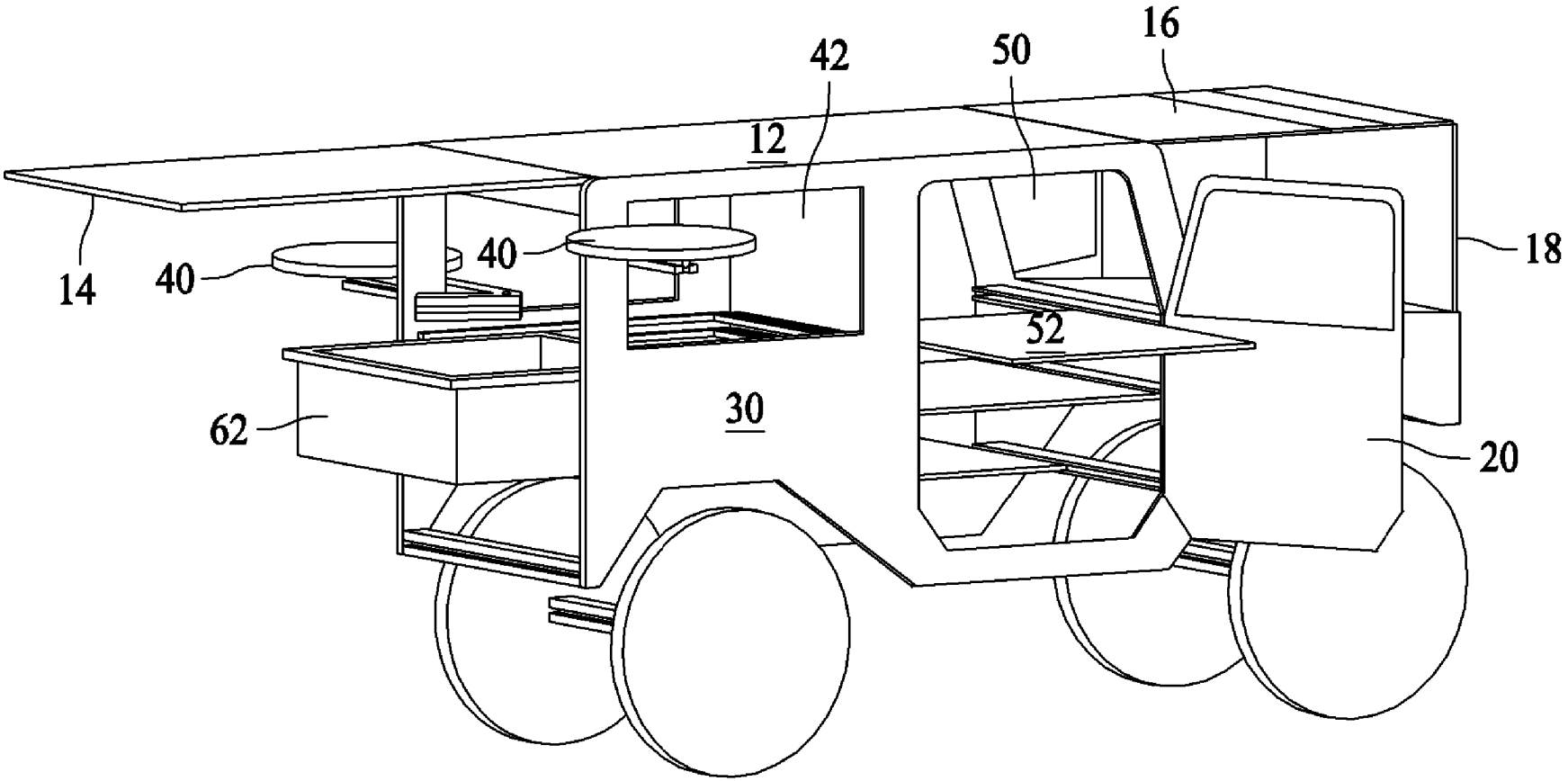
FIG. 5 is an illustration of the cart of FIG. 1 with the front and hood in an open position, providing support to and extending the top work surface.

FIG. 5 is an illustration of cart 10 with front 16 and a hood 18 in an open position. In the illustrated embodiment, hood 18 hinges open and folds out bringing the front 16 up to provide an additional extension to primary work surface 12. As illustrated, hood 18 provides support to front 16 when in the open position. In the closed position, front 16 and hood 18 can be utilized as a seat, referring back to FIG. 1. FIG. 5 also illustrates the full deployment of rotating devices 40, shelves 52, and storage bins 62. As is further described herein, cart 10 is also configured to raise and lower, providing the ergonomics that allow for varying worker height and comfort.

Figure 6:
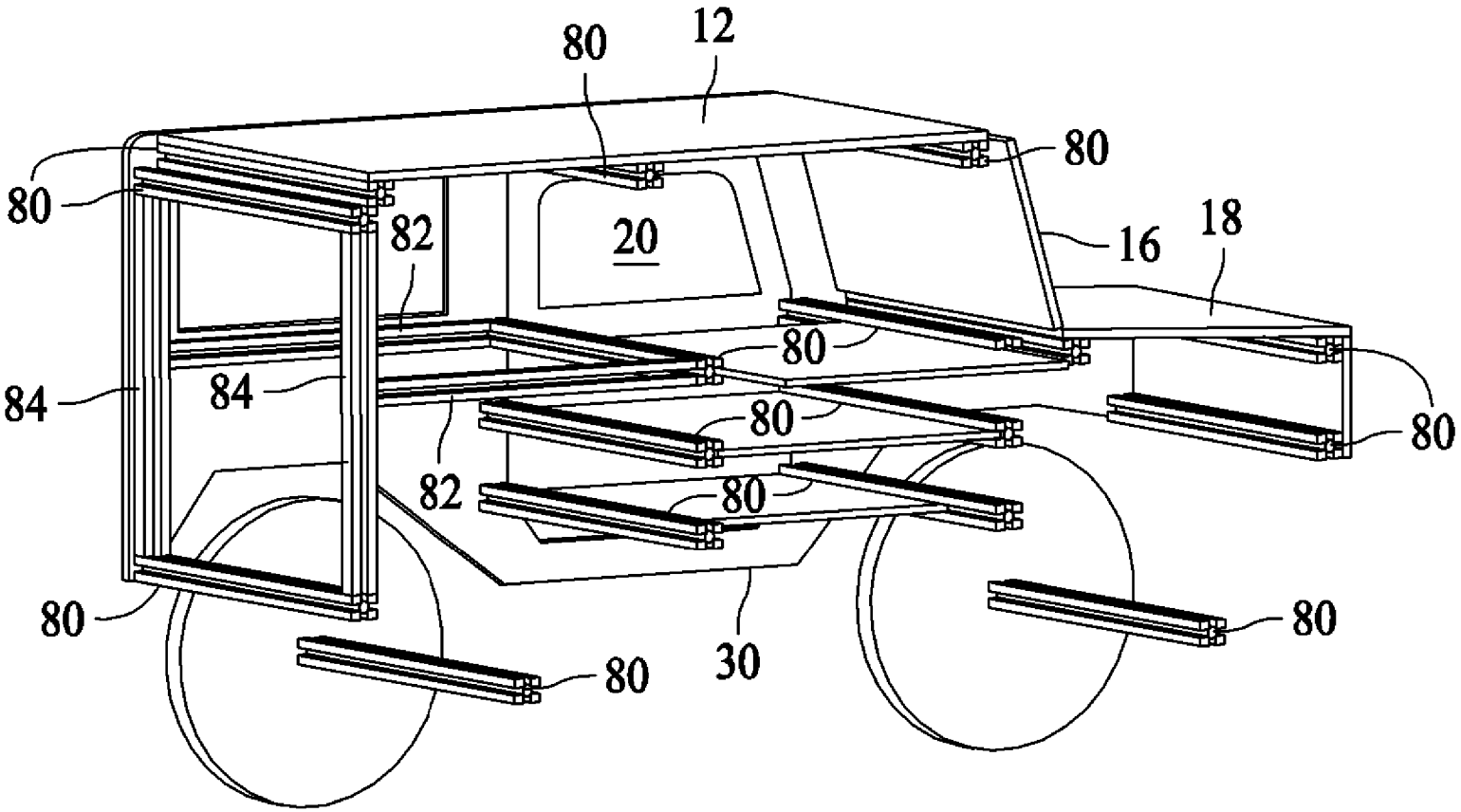
FIG. 6 is an illustration of the structural members utilized in the fabrication of the cart of FIG. 1.

FIG. 6 is an illustration of cart 10 with a portion of body 30 removed. As can be seen in FIG. 6, cart 10 a plurality of substantially parallel, lateral, structural members 80 that extend from a first side of body 30 to a second side of body 30. In fabrication, individual portions of body 30 are attached to these structural members 80. A pair of structural members 82 are perpendicular to structural members 80 and attached to respective portions of body 30. Referring back to FIG. 5, it is apparent that storage bin 62 engages structural members 82. Shelves 52 are illustrated in FIG. 6 as engaging respective structural members 80. Structural members 80 are configured to engage shelves 52 such that shelves 52 can be accessed and moved from each of the door openings 50. Though not shown in FIG. 6, it is understood that doors 20, windows 22, rear hatch 14, front 16 and hood 18 are attachable to one or more of body 30 and structural members 80, 82 and 84. Further, the above mentioned hinged arms described with respect to rotating device 40 are attached to one or more of the structural members 80, 82 and 84. Structural members 80, 82, and 84 are attachable to one another and to body 30 and other components of cart 10 using fasteners suitable for use with such structural members.

Figure 7:
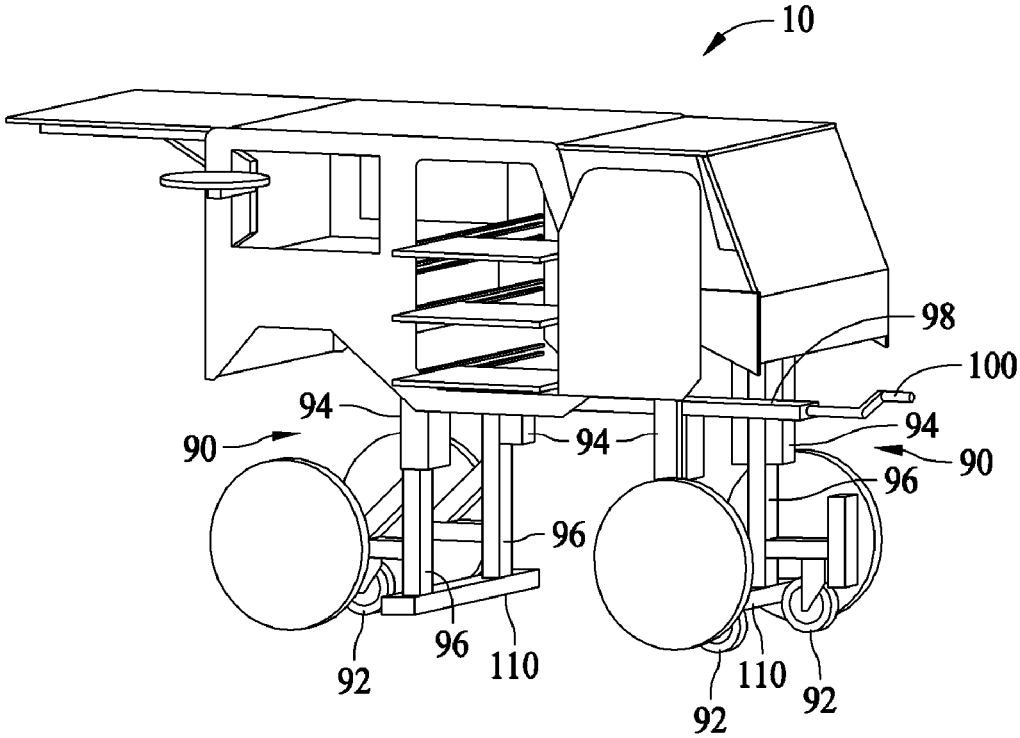
FIG. 7 is an illustration of the cart of FIG. 1 in a raised configuration.
Figure 8:
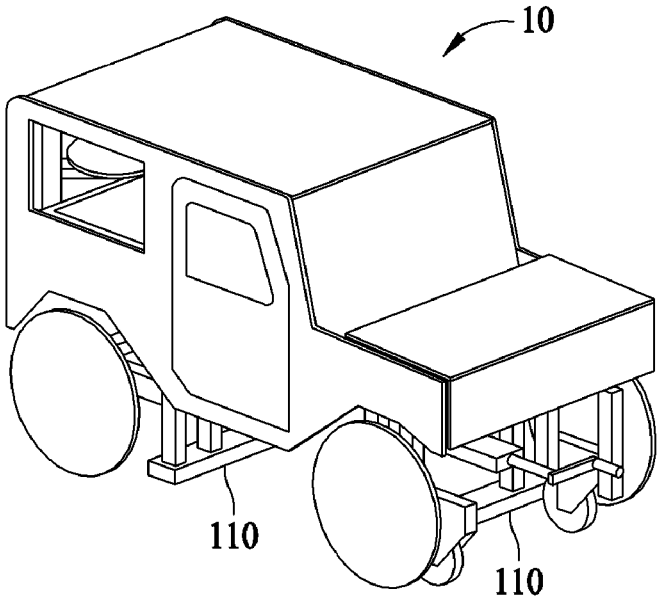
FIG. 8 is an illustration of the cart of FIG. 1 in a lowered configuration.

FIG. 7 is an illustration of cart 10 that includes a plurality of vertical members 90 in an extended position. Casters 92 are attached to vertical members 90, providing a mobility for cart 10. As seen in FIG. 7, each vertical member 90 includes a stationary member 94 and a movable member 96. In the embodiment, movable members 96 are in a mechanical arrangement with a lifting device 98. By rotating a handle 100 of lifting device 98 a position of movable members 96 are changed with respect to respective stationary members 94 to raise and lower cart 10. In an embodiment, movable members 96 are configured to at least partially fit within a portion of stationary members 94 in a slidable arrangement with respect to one another. FIG. 8 is an illustration of the cart 10 in a lowered position.

The above described embodiments of cart 10 includes one or more of a frame which is adjustable in height (described in terms of the structural members 80, 82, 84, 94, and 96), casters 92, rotating platforms 40, storage bins 62, a durable top work surface 12, and side panels described as a body 30. The work top surface 12 is extendible as described herein utilizing rear hatch 14, and front 16 with hood 18. In one embodiment, cart 10 can be utilized to lock up the materials stored therein. In such embodiments, one or more of rear hatch 14, front 16 and hood 18, doors 20 and windows 22 are configured with a locking mechanism.

In another specific embodiment, cart 10 may be configured with forklift tubes (not shown) attached to, for example, structural members 110 (shown in FIGS. 7 and 8), for engaging a forklift, for raising and lowering cart 10 from a storage area utilizing a forklift. Also, a trailer hitch (not shown) is easily attachable to one of structural members 110 or another portion of cart 10 to allow towing by another vehicle or another cart 10. For example, a cart 10 configured with one or more of a trailer hitch and a receiver, or equivalents might allow for multiple carts 10 to be towed from one location to another. As can be appreciated from the herein described modular design, end users may easily incorporate changes based on a desired end application.

In a specific application, cart 10 is configured for the support of lean manufacturing and modeling efforts. For example, a typical lean manufacturing event requires the mocking and/or modeling of proposed solutions to an identified problem. Without use of cart 10 in a stocked configuration, such an event typically entails multiple personnel having to "round up" needed materials and supplies. Sometimes this round up of materials and supplies takes at least several hours, time that could be spent in the modeling effort. However, with the utilization of cart 10, such commonly needed materials and supplies are stored therein, saving the gathering time. Replenishment of cart 10 can be done when a project is completed, and cart 10 is then fully stocked for the next modeling project.

Utilization of cart 10 reduces the amount of effort required to perform fabrication and assembly activities by facilitating an earlier start to these activities. The particular configuration of cart 10 is utilized to invoke innovation and creativity. These features reduce lost time by streamlining the above processes, thus saving time and money. While described above as being useful in a rapid modeling and prototyping environment, cart 10 is capable of being utilized in other applications. For example, cart 10 is capable of use in training or teaming exercises aimed at "out of the box" thinking and the development of innovations. Cart 10 may also be utilized in a multitude of commercial applications, including, but not limited to, food preparation activities such as tailgating, a mobile medical ambulatory service, lawn equipment supplies, entertainment supplies, storage of tools, storage of toys, or even as a portable bar and grill. While illustrated as having a vehicle configuration, the "envelope" or housing of cart 10 can be in any configuration as long as it stores all the materials required to perform a desired task and provides a work surface of sufficient size to complete the task. As described above, cart 10 is expandable and height adjustable.

While the invention has been described in terms of various specific embodiments, those skilled in the art will recognize that the invention can be practiced with modification within the spirit and scope of the claims.

What is claimed is:

1. A mobile storage and work cart comprising:

a reconfigurable frame;

a body attached to said reconfigurable frame;

a plurality of casters extending from said reconfigurable frame and operable for moving said cart;

a primary work surface attached to said reconfigurable frame and forming a top of said cart, said reconfigurable frame operable to adjust a height of said primary work surface;

an extension hingedly attached to said primary work surface at a first end thereof, said extension operable to be substantially coplanar with said primary work surface in a first position, and substantially against said body and operable as a backrest in a second position; and a support hingedly attached to both said extension and said body, said support, when in a first position, configured to support said extension in the coplanar position, and when in a second position, substantially against said body, operable as a seat, and substantially perpendicular to said extension when said extension is in the second position.

2. A mobile storage and work cart according to claim 1 further comprising a rear cover at a second end of said cart, said rear cover hingedly attached to one of said reconfigurable frame and said primary work surface, said rear cover operable to be substantially coplanar with said primary work surface in a first position.

3. A mobile storage and work cart according to claim 2 wherein said rear cover is operable as a cover for at least one opening in said body when said rear cover is in a second position.

4. A mobile storage and work cart according to claim 3 further comprising at least one of a shelf, storage bin, and drawer accessible through the at least one opening, said at least one of a shelf, storage bin, and drawer in an engagement with said reconfigurable frame.

5. A mobile storage and work cart according to claim 1 wherein a portion of said body is configured as opposing sides of said cart, said body comprising at least one opening formed in each side, said openings opposite to and corresponding with one another, said cart further comprising a cover for each said opening.

6. A mobile storage and work cart according to claim 5 wherein said openings are configured to provide access, from both sides of said cart, to at least one of a shelf, a storage bin, and a drawer slidingly engaged with said reconfigurable frame.

7. A mobile storage and work cart according to claim 1 wherein said body comprises an opening formed therein, said cart further comprising:

at least one hinged arm; and at least one rotating device supported and attached to said at least one hinged arm, each said rotating device having a top surface configured as at least one of a work surface and a storage area, each said hinged arm and each said rotating device accessible through said opening in said body such that each said rotating device is capable of passing through said opening for deployment in a first position outside of said body.

8. A mobile storage and work cart according to claim 7 comprising a cover for said opening.

9. A mobile storage and work cart according to claim 1 wherein said reconfigurable frame comprises a plurality of vertical members, each of said plurality of casters attached to a respective vertical member.

10. A mobile storage and work cart according to claim 9 wherein each said vertical member comprises:

a stationary member; and a movable member in a sliding engagement with said stationary member.

11. A mobile storage and work cart according to claim 10 further comprising a lifting device further comprising a handle, said movable members in a mechanical arrangement with said lifting device such that operation of said handle causes a position of said movable members to move with respect to a position of said stationary members, resulting in one or both of raising and lowering said primary work surface.

12. A mobile workstation comprising:

a body forming a substantial perimeter of said workstation;

a height adjustable work surface configured as a top of said body;

a plurality of structural members to which said body is attached;

a plurality of casters, each said caster attached to one or more of said structural members, said structural members arranged to provide height adjustment of said work surface;

a plurality of shelves and storage units each slidably engaged with one or more of said structural members, said plurality of shelves and storage units configured for containment within said body when not in use; and a first work surface extension hingedly attached to said workstation at a first end thereof, said first work surface extension comprising:

a secondary work surface operable to be substantially coplanar with said height adjustable work surface in a first position, and substantially against said body and operable as a backrest in a second position; and a support member hingedly attached to both said secondary work surface and said body, said support member, when in a first position, configured to support said secondary work surface in the coplanar position, and when in a second position, substantially against said body, operable as a seat, and substantially perpendicular to said secondary work surface.

13. A mobile workstation according to claim 12 comprising a second work surface extension hingedly attached to said workstation at a second end thereof, said second work surface extension operable to be substantially coplanar with said height adjustable work surface in a first position, and substantially against said body in a second position.

14. A mobile workstation according to claim 12 wherein said structural members comprise a plurality of vertical members, each of said plurality of casters attached to a respective vertical member.

15. A mobile workstation according to claim 14 wherein said structural members further comprise a lifting device, said structural members in a mechanical arrangement with said lifting device such that operation of said lifting device causes an adjustment of said structural members to change a distance between said plurality of casters and said height adjustable work surface.

16. A mobile workstation according to claim 12 further comprising:

a hinged arm attached to at least one of said structural members; and a rotating device supported by and attached to said hinged arm, said rotating device having a top surface configured as at least one of a work surface and a storage area, said hinged arm operable for passing said rotating device through an opening in said body such that said rotating device may be contained within said body when not in use.

17. A mobile workstation according to claim 12 further comprising forklift tubes operatively attached to one or more structural members.

18. A mobile workstation according to claim 12 further comprising at least one of a trailer hitch and a receiver attached to one of said structural members or said body.

* * * * *